US011326774B2

(12) United States Patent
Sapanaro et al.

(10) Patent No.: US 11,326,774 B2
(45) Date of Patent: May 10, 2022

(54) COAL NOZZLE ASSEMBLY FOR A STEAM GENERATION APPARATUS

(71) Applicant: General Electric Technology GmbH, Baden (CH)

(72) Inventors: Michael Sapanaro, Windsor, CT (US); Frederic Vitse, Windsor, CT (US); Rachel Ladue, Windsor, CT (US); Joseph Krawiec, Windsor, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 175 days.

(21) Appl. No.: 16/635,005

(22) PCT Filed: Jul. 26, 2018

(86) PCT No.: PCT/EP2018/070321
§ 371 (c)(1),
(2) Date: Jan. 29, 2020

(87) PCT Pub. No.: WO2019/025287
PCT Pub. Date: Feb. 7, 2019

(65) Prior Publication Data

US 2020/0158331 A1 May 21, 2020

(30) Foreign Application Priority Data

Jul. 31, 2017 (EP) ..... 17184059

(51) Int. Cl.
*F23C 13/06* (2006.01)
*F23C 5/02* (2006.01)
*F23D 1/00* (2006.01)

(52) U.S. Cl.
CPC ..... *F23C 13/06* (2013.01); *F23C 5/02* (2013.01); *F23D 1/00* (2013.01); *F23D 2201/10* (2013.01);
(Continued)

(58) Field of Classification Search
CPC ..... F23D 1/00; F23D 2201/10
See application file for complete search history.

(56) References Cited

U.S. PATENT DOCUMENTS 4,415,537 A 11/1983 Vine et al.
2009/0277364 A1 11/2009 Donais et al.
(Continued)

FOREIGN PATENT DOCUMENTS

GB 2 114 016 A 8/1983
JP S61 223411 A 10/1986

OTHER PUBLICATIONS

International Search Report of the International Searching Authority for PCT/EP2018/070321 dated Oct. 17, 2018.

*Primary Examiner* — David J Laux
(74) *Attorney, Agent, or Firm* — Grogan, Tuccillo & Vanderleeden, LLP

(57) ABSTRACT

A steam generating system includes a nozzle assembly for pulverized coal and air, the coal nozzle assembly comprises an inner housing (3) for conveying primary air and coal and an outer housing (5) for conveying secondary air to an exit face (13) of a nozzle tip (1), wherein the outer housing (3) and the inner housing (5) are arranged coaxially and limit a channel (15) for the secondary air, wherein the cross-sectional area ($A_{IH}$) of the inner housing (3) increases towards the exit face (13) of the nozzle tip (1), wherein the cross-sectional area ($A_{OH}$) of the outer housing (5) decreases towards the exit face (13), and wherein bars (11) are located in the inner housing (3) near the exit face (13) that accelerate the velocity of the primary air and coal particles.

17 Claims, 3 Drawing Sheets

(52) U.S. Cl.
CPC ..... *F23D 2201/20* (2013.01); *F23D 2201/30* (2013.01); *F23D 2900/00001* (2013.01)

(56) References Cited

U.S. PATENT DOCUMENTS

| | | | | |
|---|---|---|---|---|
| 2010/0081100 | A1* | 4/2010 | Olver | F23D 1/00 431/159 |
| 2011/0048293 | A1* | 3/2011 | Grusha | F23D 1/00 110/261 |
| 2014/0011141 | A1* | 1/2014 | Matsumoto | F23D 1/005 431/12 |
| 2014/0305355 | A1 | 10/2014 | D'Agostini et al. | |

* cited by examiner

COAL NOZZLE ASSEMBLY FOR A STEAM GENERATION APPARATUS

BACKGROUND OF INVENTION

This disclosure relates to a nozzle assembly for a steam generation apparatus for directing the flow of solid particles entrained in a fluid system into a combustor or furnace. It further relates to a steam generating system which comprises a furnace and at least one coal nozzle assembly.

PRIOR ART

A solid fueled firing system burns powdered solid fuel, typically coal, blown into a furnace in a stream of air. This furnace is typically a boiler that creates steam for various uses, such as creating electricity.

When the pulverized coal particles are conveyed through the duct work from the coal mill to the coal nozzle assembly by means of primary air they tend to aggregate at various paths. The resulting partial separation of coal particles and the primary air among other negative effects reduce the burning efficiency in the furnace and raise the amount of pollutants in the fuel gas, which is undesirable. Among other pollutants reducing the NOx-Emissions is of great importance to operate a steam generating unit in compliance with the limits set by the government. A very efficient way to reduce NOx-emission is to control the combustion such that only little NOx is generated.

From U.S. Pat. No. 8,955,776 a nozzle for solid fueled furnaces is known comprising several flat guide vanes arranged parallel to each other in the exit area of the nozzle to direct the flow of primary air and coal particles into the furnace.

The nozzle and the guide vanes are integrally formed for example by casting. The guide vanes are more or less parallel to each other resulting in a sub-optimal mixture of the partially aggregated coal particles and the primary air before exiting the nozzle and entering the furnace.

Currently, there is a need for an improved coal nozzle assembly resulting in a more homogenous mixture of coal particles and primary air just before being burnt in the furnace thus resulting in a higher efficiency of the furnace and less pollutants, like for example NOx, in the flue gas.

SUMMARY OF THE INVENTION

The claimed coal nozzle assembly for a steam generation apparatus comprises a nozzle tip with an inner housing for conveying primary air and coal to an exit face of the nozzle tip and into a furnace and an outer housing for conveying secondary air into the furnace, wherein the outer housing and the inner housing are arranged coaxially and limit a channel for the secondary air, wherein a cross-sectional area $A_{IH}$ of the inner housing increases towards the exit face of the nozzle tip, wherein the cross-sectional area ($A_{OH}$) of the outer housing decreases towards the exit face and wherein at least one bar is located in the inner housing near the exit face.

This geometry results in a constrained diverging cross section of the inner housing and a reduction of the velocity of the primary air and the entrained coal particles. It generates a low velocity area within the nozzle tip. The deceleration and the resulting low velocity area promote mixing of coal and primary air.

In the last section (or most downstream section) of the nozzle tip the at least one bar reduces the cross section area of the nozzle tip and increases the velocity of primary air and coal slightly before entering the furnace to prevent the ignition point from being pulled inside the nozzle tip. The bars may extend between two opposite walls of the inner housing and may have triangular cross section, the tip of this triangle being the most upstream part of the bar. This reduces the pressure drop of the nozzle tip compared to for example a square cross section of the bars or the like.

The secondary air flows through the channel surrounding the inner housing. Due to the claimed geometry of this channel the velocity of the secondary air is increased in the nozzle tip. Increasing the velocity of the secondary air while decreasing the velocity of the primary air and the entrained coal particles maintains separation between the secondary air and the coal particles entrained in the primary air for proper combustion staging and reduced Nox-emissions. The geometry of the claimed nozzle tip acts to create a more effective separation between the primary air and the secondary air.

The coal nozzle assembly according to the invention generates a well-mixed and rather homogenous stream of coal and primary air by mixing the coal particles and the primary air in the furnace immediately before the combustion takes place, rather than solely relying on mixing inside the tip.

It has been proven advantageous if the inner housing and/or the outer housing have a square or rectangular cross-section. Among other advantages this geometry allows producing the nozzle from sheet metal in a cost-effective way.

Further advantageous embodiments comprise at least two or more parallel bars extending between two opposite walls of the inner housing or several bars being arranged as a grid. These multiple bars further reduce the exit area of the inner housing and accelerate the primary air.

To induce stall of the primary air from the bars and improve mixing of primary air and coal particles the trailing edges of the bars have a blunt end. In case the bars have a triangular cross section this is the case if the tip of this triangle is the most upstream part of it.

Further it is possible to cover the trailing ends of the bars by a cover plate to prevent abrasion of the trailing edges. In case the cover plates are worn, they can easily be replaced. In this embodiment the cover plates induce stall of the primary air.

It has been proven advantageous if the relation between the cross section Area ($A_{IH}$) of the inner housing at the entrance of the primary air into the nozzle tip and the exit face is within a range of 1.2 to 1.5, preferably 1.3.

It has further been proven advantageous if the bars reduce the cross section Area ($A_{IH}$) of the inner housing at the exit face by a factor within a range of 0.2 to 0.5, preferably by a factor of 0.25.

It has been proven advantageous if the relation between the cross section area ($A_{OH}$) of the outer housing at the entrance of the primary air and the exit face is within a range of 0.3 to 0.5, preferably 0.4.

The Nox-emission can even further be reduced if a catalyst is applied to the internal walls of the nozzle tip, to the bars and/or the cover plate. The catalyst becomes more effective in the regions of decelerated flow, i. e. on the inner surface of the inner housing just upstream of the bars and on their blunt ends or on the cover plates.

The catalyst may be of the perovskite-type with catalytic activity in the preferred temperature range, but not limited to, of 500° C. to 900° C. and/or may be Lanthanum Strontium Titanate doped with metals.

Further advantages are disclosed in the figures, their description and the claims.

DETAILED DESCRIPTION OF THE DRAWINGS

Figure 1:
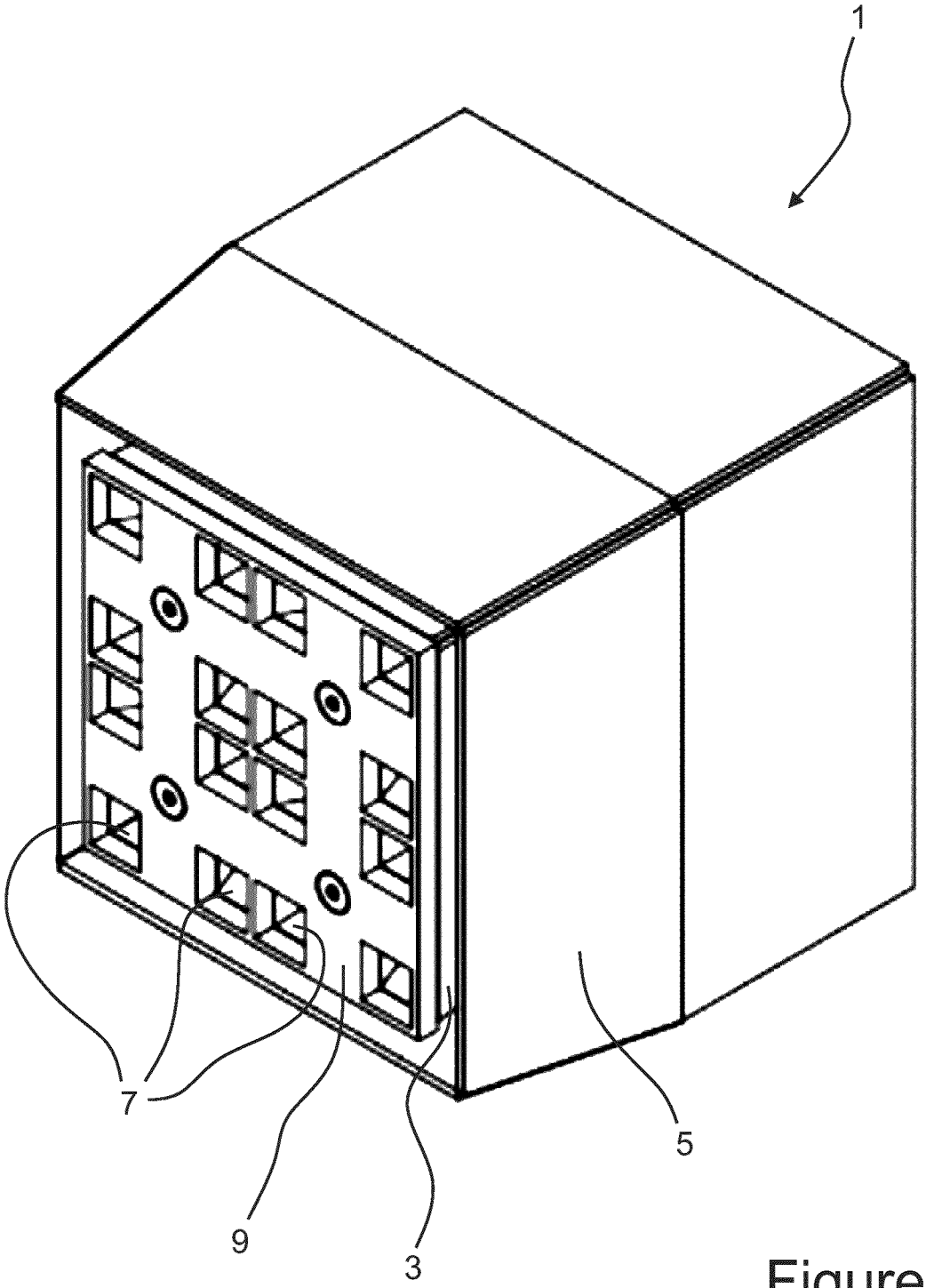
FIG. 1: A perspective view of an embodiment of a nozzle tip according to the invention.

FIG. 1 illustrates a perspective view of a nozzle tip 1 according to the invention. An inner housing 3 of the nozzle tip 1 is surrounded by an outer housing 5. The space between the outer housing 5 and the inner housing 3 forms a channel for transporting secondary air into a furnace (not shown). The secondary air exits the nozzle tip 1 via a square or rectangular gap between the inner housing 3 and the outer housing 5, thus building a perimeter flow of secondary air. This gap between the inner housing 3 and the outer housing 5 is the exit area of the a.m. channel for transporting secondary air.

The primary air and the entrained coal particles exit the nozzle tip 1 through openings 7 in a cover plate 9. For reasons of clarity, not all openings 7 have reference numerals. Altogether, there are sixteen (square) openings 7 visible in FIG. 1.

As can be seen from FIG. 1, the cover plate 9 has a grid-like design dividing an exit face of the nozzle tip 1 in sixteen openings 7.

Figure 2:
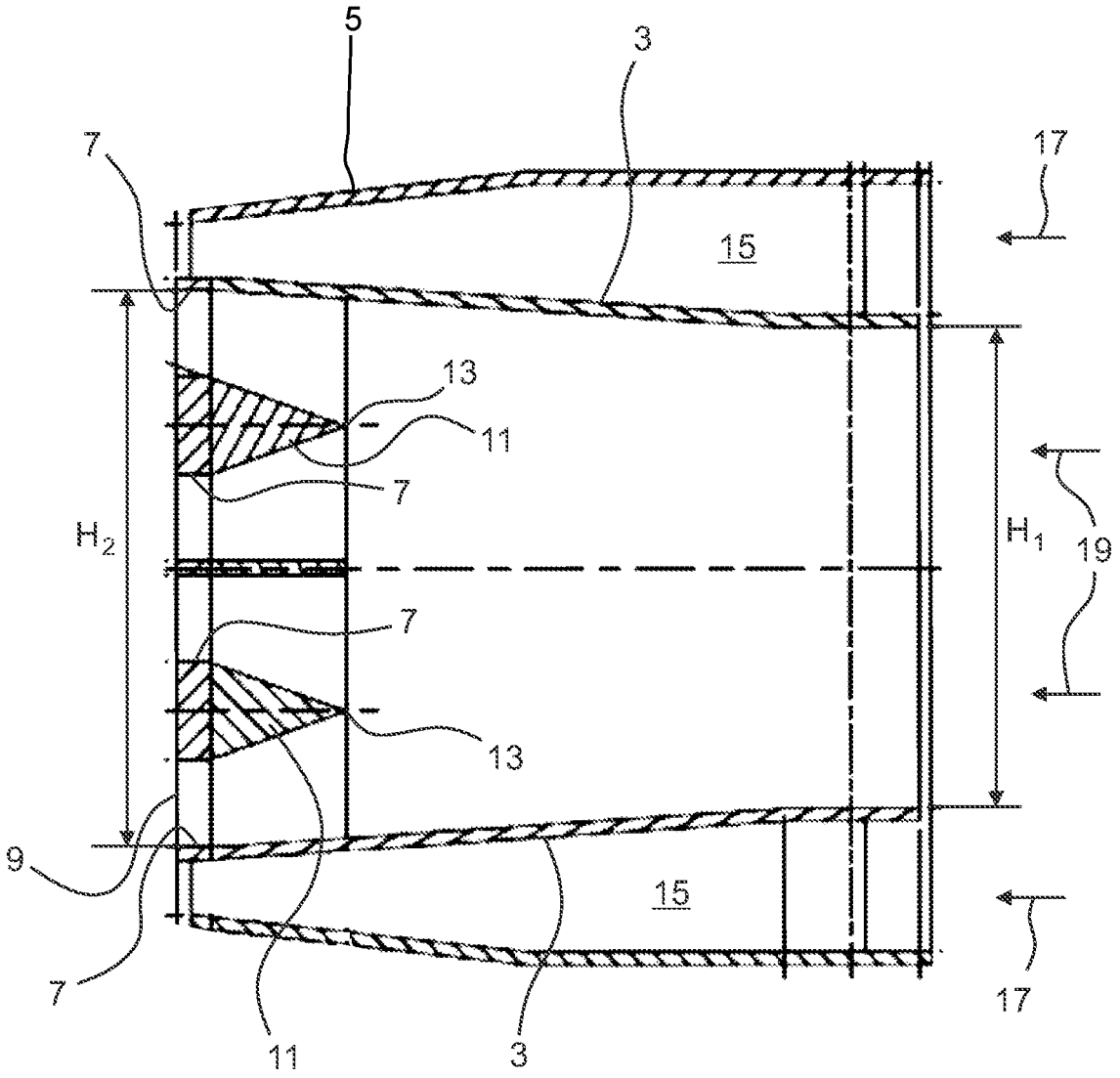
FIG. 2: A longitudinal section of the nozzle of FIG. 1.

FIG. 2 shows a longitudinal section through the nozzle tip 1 according to FIG. 1.

In FIG. 2 the inner housing 3 can be seen more clearly than in FIG. 1. The cross sectional area of the inner housing on the right side of FIG. 1 (this is where the primary air and the coal enter the nozzle tip 1) is smaller than the cross sectional area of the inner housing at the cover plate 9. In this view the cross sectional area cannot be seen. Only the height H can be seen. Of course, the cross section area A depends from the height H; in case of a square the cross section area A=H×H.

The difference in the height of the inner housing 3 can be used to illustrate this fact. In FIG. 2 the height H1 at the entrance of the primary air into the inner housing 3 is smaller than the height H2 near the cover plate 9 of the inner housing 3. The different heights H1, H2 indicate the growth of the cross sectional area A of the inner housing 3 from the entry towards the cover plate 9.

This increasing cross sectional area A of the inner housing 3 reduces the velocity of the flow of the primary air which promotes mixing of the coal particles and the primary air.

This mixing takes place inside the nozzle tip 1. To avoid that the flame is pulled inside the nozzle tip 1 at least one bar 11 is arranged near an exit face of the nozzle tip 1. The downstream and blunt end of the at least one bar 11 may be protected against abrasion by an optional cover plate 9.

In this embodiment the bars 11 have a triangular cross section and are arranged in a grid-like manner. A tip of this triangular cross section of the bars 11 has the reference numeral 13 and is the most upstream part of the bars 11.

As a result, the primary air flowing through the inner housing 3 is accelerated just before exiting the nozzle tip via the openings 7 between the bars 11 and in the optional cover plate 9. This prevents pulling the ignition point of the flame inside the inner housing 3.

It is obvious, that the bars 11 not necessarily have a triangular cross section. Other cross sections resulting in an acceleration of the velocity of the primary air without raising the pressure drop more than necessary are possible, too.

The cover plate 9 is an optional feature to prevent the downstream and blunt end of the bars 11 from abrasion. Either the blunt end of the bars or the cover plate 9 induce stall to the primary air which initializes further mixing of coal particles and the primary air when entering the furnace.

As can be seen from FIG. 2, the outer housing 5 and the inner housing 3 limit a channel 15 through which the secondary air (cf. the arrows 17) flows. The primary air that flows through the inner housing 3 is illustrated by arrows 19.

As further can be seen from FIG. 2, the cross sectional area of the channel 15 near the cover plate 9 or the blunt ends of the bars 11 is smaller than at the entrance of the secondary air (on the right side of FIG. 2).

Further, the outer housing 5 is formed as a truncated pyramid near the cover plate 9, thus directing the secondary air exiting the gap 20 between the outer housing 5 and the inner housing 3 inwardly to keep the primary air focused and directed to the flame inside the furnace (not visible).

The claimed nozzle tip results in an efficient combustion and low NOx emissions.

To further reduce the NOx emissions of the claimed Ultra-Low NOx burner nozzles a catalyst 21 may be applied to the internal walls of the nozzle tip 1, namely the inner surfaces of the inner housing 3, the bars 11 and the cover plate 9 that are in contact with the primary air and the entrained coal particles. The catalyst 21 is more effective in the regions of decelerated flow, i. e. the inner surface of the inner housing 3 just upstream of the bars 11.

Catalytic combustion of the volatile matter in the injected fuel is achieved at temperatures favorable for the reduction of NOx species originating from the volatile matter or partial combustion of solid fuels. Catalytic combustion inside the nozzle tip also improves the quality of the flame downstream and corresponding reduced NOX emission within the furnace.

Catalytic combustion of the volatile matter in the injected fuel is achieved at temperatures favorable for the reduction of NOx species originating from the volatile matter or partial combustion of solid fuels. Catalytic combustion on the nozzle cover plate also improves the quality of the flame and corresponding reduced NOX emission within the furnace.

The catalyst may be of the perovskite-type with catalytic activity in the preferred temperature range, but not limited to, of 500° C. to 900° C.

Figure 3:
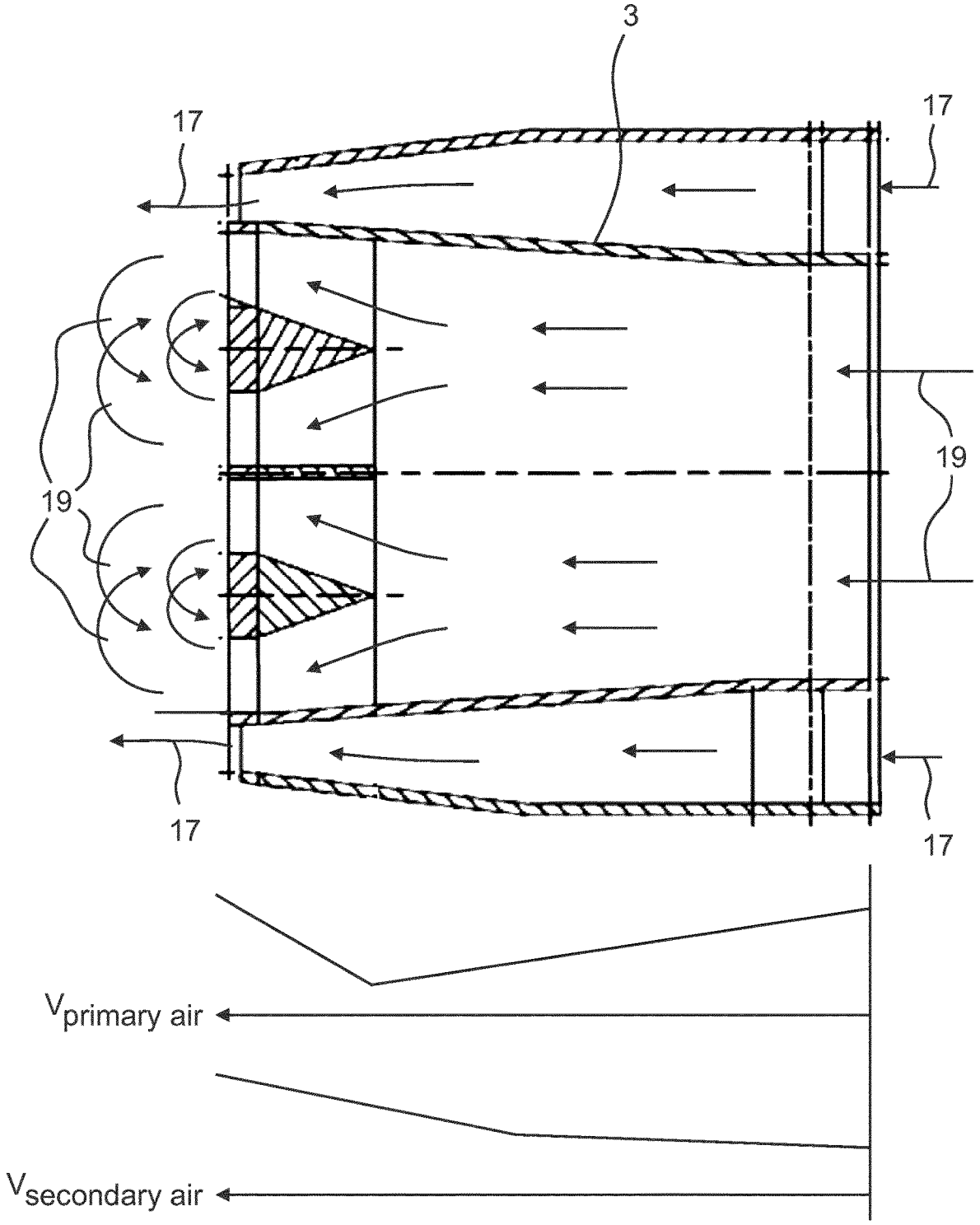
FIG. 3: A longitudinal section of the nozzle of FIG. 1 illustrating the flow of the primary and the secondary air.

FIG. 3 shows the cross section of FIG. 2 without reference numerals but with the arrows 17 and 19 to illustrate the flow and the mixing of the primary air and the coal particles behind the cover plate 9 in the furnace.

Further, the velocity of the primary air and the secondary air is shown in two diagrams. The respective deceleration and the subsequent acceleration of the primary air are illustrated as well as the acceleration of the secondary air.

LIST OF REFERENCE NUMERALS

1 nozzle tip
3 inner housing
5 outer housing
7 opening
9 cover plate
11 bar
13 tip of the bar
13 exit face

15 channel
17 arrows (secondary air)
19 arrows (primary air)
20 gap
21 catalyst

The invention claimed is:

1. A coal nozzle assembly for a steam generation apparatus, comprising:

an inner housing for conveying primary air and coal through a nozzle tip toward an exit face;

an outer housing for conveying secondary air through the nozzle tip;

at least one bar located in the inner housing near the exit face; and a cover plate downstream of the at least one bar to prevent abrasion of the trailing edges of the at least one bar, wherein the outer housing and the inner housing are arranged coaxially and limit a channel for the secondary air, wherein the cross-sectional area ($A_{IH}$) of the inner housing increases towards the exit face of the nozzle tip, wherein the cross-sectional area ($A_{OH}$) of the outer housing decreases towards the exit face.

2. The coal nozzle assembly according to claim 1, wherein the inner housing has a square or rectangular cross-section.

3. The coal nozzle assembly according to claim 1, wherein the outer housing has a square or rectangular cross-section.

4. The coal nozzle assembly according to claim 1, wherein the at least one bar extends between two opposite walls of the inner housing.

5. The coal nozzle assembly according to claim 1, wherein the at least one bar comprises two or more bars extending between two opposite walls of the inner housing and being arranged parallel to each other.

6. The coal nozzle assembly according to claim 5, wherein the bars are arranged as a grid.

7. The coal nozzle assembly according to claim 1, wherein the relation between the cross section Area ($A_{IH}$) of the inner housing at the entrance of the primary air and the exit face is within a range of 1.2 to 1.5.

8. The coal nozzle assembly according to claim 7, wherein the relation between the cross section Area ($A_{IH}$) of the inner housing at the entrance of the primary air and the exit face is 1.3.

9. The coal nozzle assembly according to claim 1, wherein the at least one bar reduces the cross section Area ($A_{IH}$) of the inner housing at the exit face by a factor within the range of 0.2 to 0.5.

10. The coal nozzle assembly according to claim 9, wherein the factor is 0.25.

11. The coal nozzle assembly according to claim 1, wherein the relation between the cross section Area ($A_{OH}$) of the outer housing at the entrance of the primary air and the exit face is 0.4.

12. The coal nozzle assembly according to claim 1, wherein the relation between the cross section Area ($A_{OH}$) of the outer housing at the entrance of the primary air and the exit face is within a range of 0.3 to 0.5.

13. The coal nozzle assembly according to claim 1, wherein a catalyst is applied to the internal walls of the nozzle tip, wherein the catalyst is applied to the inner surface of the inner housing and/or the at least one bar.

14. The coal nozzle assembly according to claim 13, wherein the catalyst comprises Lanthanum Strontium Titanate.

15. The coal nozzle assembly according to claim 1, wherein a catalyst is applied to a cover plate of the nozzle tip.

16. A method comprising:

implementing a coal nozzle assembly in a steam generation apparatus, the coal nozzle assembly including:

an inner housing for conveying primary air and coal particles through a nozzle tip toward an exit face;

an outer housing for conveying secondary air through the nozzle tip, at least one bar located in the inner housing near the exit face; and a cover plate downstream of the at least one bar to prevent abrasion of the trailing edges of the at least one bar, wherein the outer housing and the inner housing are arranged coaxially and limit a channel for the secondary air, wherein the cross-sectional area ($A_{IH}$) of the inner housing increases towards an exit face of the nozzle tip, wherein the cross-sectional area ($A_{OH}$) of the outer housing decreases towards the exit face; and operating the coal nozzle assembly to convey the primary air and the coal particles through the inner housing toward the exit face and to convey the secondary air through the outer housing, wherein the operating includes:

decelerating the flow of the primary air and the coal particles;

subsequently accelerating the flow of primary air and the coal particles;

mixing the flow of primary air and the coal particles by inducing a stall when exiting the inner housing; and enclosing the primary air and the coal particles by a perimeter flow of the secondary air.

17. A steam generating system, comprising:

a furnace; and a coal nozzle assembly for directing a flow of solid particles entrained in a fluid into the furnace, wherein the coal nozzle assembly includes:

a nozzle tip;

an inner housing for conveying primary air and coal through the nozzle tip toward an exit face;

an outer housing for conveying secondary air through the nozzle tip, at least one bar located in the inner housing near the exit face; and a cover plate downstream of the at least one bar to prevent abrasion of the trailing edges of the at least one bar, wherein the outer housing and the inner housing are arranged coaxially and limit a channel for the secondary air, wherein the cross-sectional area ($A_{IH}$) of the inner housing increases towards an exit face of the nozzle tip, and wherein the cross-sectional area ($A_{OH}$) of the outer housing decreases towards the exit face.

* * * * *